US008525084B2

(12) United States Patent
O'Connor

(10) Patent No.: US 8,525,084 B2
(45) Date of Patent: Sep. 3, 2013

(54) ELECTRICAL HEATING ELEMENT

(75) Inventor: Jason Daniel Harold O'Connor, Glossop (GB)

(73) Assignee: Heat Trace Limited, Frodsham (GB)

( * ) Notice: Subject to any disclaimer, the term of this patent is extended or adjusted under 35 U.S.C. 154(b) by 1001 days.

(21) Appl. No.: 11/721,927

(22) PCT Filed: Dec. 15, 2005

(86) PCT No.: PCT/GB2005/004849

§ 371 (c)(1),
(2), (4) Date: Aug. 28, 2008

(87) PCT Pub. No.: WO2006/064242

PCT Pub. Date: Jun. 22, 2006

(65) Prior Publication Data

US 2009/0212040 A1 Aug. 27, 2009

(51) Int. Cl.
*H05B 3/10* (2006.01)
*H05B 3/44* (2006.01)

(52) U.S. Cl.
USPC ..... 219/548; 219/544

(58) Field of Classification Search
USPC ..... 219/542–549
See application file for complete search history.

(56) References Cited

U.S. PATENT DOCUMENTS

| | | | | |
|---|---|---|---|---|
| 4,042,534 | A | 8/1977 | Andrianov et al. | |
| 4,170,677 | A * | 10/1979 | Hutcheson | 428/119 |
| 4,568,592 | A * | 2/1986 | Kawaguchi et al. | 428/107 |
| 4,876,440 | A * | 10/1989 | Kamath et al. | 219/548 |
| 5,111,025 | A * | 5/1992 | Barma et al. | 219/217 |
| 5,122,641 | A | 6/1992 | DeChurch | |
| 5,334,330 | A * | 8/1994 | Rowlette | 252/512 |
| 5,769,996 | A | 6/1998 | McArdle et al. | |
| 6,288,372 | B1 * | 9/2001 | Sandberg et al. | 219/544 |

FOREIGN PATENT DOCUMENTS

CN 1135704 11/1996

OTHER PUBLICATIONS

International Search Report dated Mar. 2, 2006.

* cited by examiner

*Primary Examiner* — Sang Paik
(74) *Attorney, Agent, or Firm* — Michael Best & Friedrich LLP

(57) ABSTRACT

An electrical device includes a compound material. The compound material includes a mixture of an electrically conductive material and an electrically insulative material. The conductive material is aligned within the compound material, such that the resistivity of the compound material in a first direction is different from the resistivity of the compound material in a second direction perpendicular to the first direction.

25 Claims, 6 Drawing Sheets

ELECTRICAL HEATING ELEMENT

CROSS-REFERENCE TO RELATED APPLICATIONS

This patent application is a national stage filing under 35 U.S.C. 371 of International Application No. PCT/GB2005/004849, filed Dec. 15, 2005, which claims priority to Great Britain Patent Application No. 0427650.7, filed Dec. 17, 2004, the disclosures of which are incorporated by reference herein in their entireties.

The present invention relates to an electrical device, and in particular to an electrical device comprising a material that is a mixture of a conductive material and an insulative material, as well as to methods of manufacturing such a device. The material is particularly suitable for use in electrical cables, such as heating cables.

Heating cables fall into two general categories, that is parallel resistance types and series resistance types. Series resistance heating cables typically comprise one or more longitudinally extending resistance wires embedded in insulation material selected to withstand the operating temperatures of the cable.

In parallel resistance cable types, generally two insulated conductors (known as bus wires) extend longitudinally along the cable. A resistive heating element is in electrical contact with both bus wires.

The parallel heating element typically takes one of two forms. The element may be a resistance heating wire spiraled around the conductors, with electrical connections being made alternatively at intervals along the longitudinally extending conductors. This creates a series of short heating zones spaced apart along the length of the cable. The heating wire must be selectively insulated from the conductors, and also encased within an insulating sheath.

Alternatively, the heating element may take the form of an extruded matrix extending between, and in electrical contact with, the two conductors. Often, semi-conductive (i.e. partially-conductive) materials having a positive temperature coefficient of resistance (a PTC characteristic) are selected for the heating element. Thus as the temperature of the element increases, the resistance of the material electrically connected between the conductors increases, thereby reducing power output. Such heating cables, in which the power output varies according to temperature, are said to be self-regulating or self-limiting.

FIG. 1A illustrates a typical parallel resistance self-regulating heating cable 2. The cable consists of a semi-conductive polymeric matrix 8 extruded around the two parallel power supply conductors 4, 6. The conductors 4, 6 are typically formed of a metal such as copper. In use, an electrical power supply is connected across the conductors. The matrix 8 serves as the heating element. The matrix 8 is typically a mixture of a conductive filler material such as carbon and an insulative material such as polyethylene. The matrix is semi-conductive as the overall bulk resistivity of the matrix is less than the resistivity of an insulator, but greater than the resistivity of a conductor.

A polymeric insulator jacket 10 is often extruded over the matrix 8. Typically a conductive outer braid 12 (e.g. a tinned copper braid) is added for additional mechanical protection and/or use as an earth wire. Such a braid is typically covered by a thermoplastic overjacket 14 for additional mechanical and corrosive protection.

FIG. 1B is a schematic diagram indicating the effective circuit provided by the parallel resistance type cable 2 shown in FIG. 1A. In functional terms, the heating element 8 can be envisaged as effectively a series of resistors R connected in parallel between the two conductors 4, 6. In operation, a voltage $V_s$ is applied across the conductors 4, 6, with the cable providing heat due to the subsequent ohmic heating of the heating element material 8.

It is an aim of the embodiments of the present invention to provide an improved heating cable comprising a material that is a mixture of a conductive material and an insulative material, that substantially obviates or mitigates one or more problems of the prior art, whether referred to herein or otherwise. In particular it is an aim of preferred embodiments to provide a heating cable that is cheaper and easier to manufacture. It is also an aim of other preferred embodiments to provide a heating cable that has improved insulative properties.

According to a first aspect of the present invention there is provided an electrical device comprising: a compound material comprising a mixture of an electrically conductive material and an electrically insulative material; wherein the conductive material is orientated within the compound material such that the resistivity of the compound material in a first direction is different from the resistivity of the compound material in a second direction substantially perpendicular to the first direction.

Said resistivities may differ by at least one order of magnitude.

The resistivity in one of said directions may be equal to the resistivity of a conductor, and the resistivity in the other direction may be equal to that of an insulator.

The compound material may have a positive temperature coefficient of resistance.

The conductive material may comprise at least one of: a metal; spherical carbon; carbon fibre; highly structured carbon; carbon nanotubes; and graphite.

The conductive material may be arranged as a plurality of individual particles within the compound material, the particles being at least one of: spherical, structured, multi-layered, or bar shaped.

Said device may comprise an electrical conductor comprising a longitudinal axis extending along the conductor, wherein said conductive material is orientated within the compound material such that the resistivity of the compound material in a first direction parallel to the longitudinal axis is lower than the resistivity of the compound material in a second direction substantially perpendicular to the longitudinal axis.

Said conductor may comprise an electrical cable.

Said device may be an electrical heating cable comprising: a heating element; a longitudinal axis extending along the cable; wherein said conductive material is orientated within the compound material such that the resistivity of the compound material in a first direction parallel to the longitudinal axis is different from the resistivity of the compound material in a second direction substantially perpendicular to the longitudinal axis.

The heating element may comprise said compound material.

The heating cable may be a parallel resistance heating cable, comprising at least two power supply conductors extending along the length of the cable, said heating element extending along the cable and between the conductors, and connected in parallel between the conductors; wherein the resistivity of the compound material along the direction in which it extends between the conductors is less than the resistivity of the compound material in the first direction.

The heating cable may be a series resistance heating cable, with the heating element extending longitudinally along the cable, the cable comprising at least two power supply conductors connected to respective ends of the heating element, wherein the resistivity of the compound material in the first direction is less than the resistivity of the compound material in the second direction.

At least a portion of said compound material may be arranged as a sheath substantially enclosing the heating element.

The resistivity of the sheath in the second direction may be substantially equal to that of an insulator, such that the sheath forms an insulative jacket.

The resistivity of the sheath in the first direction may be less than the resistivity of the sheath in the second direction, such that the sheath may be used as a conductive earth.

The heating cable may be fitted to a seat, and arranged to act as a seat heater. The seat may for example be a seat of a vehicle.

According to a second aspect, the present invention provides a method of manufacturing an electrical device the method comprising: providing a compound material comprising a mixture of an electrically conductive material and an electrically insulative material; orientating the conductive material such that the resistivity of the compound material in a first direction is different to the resistivity of the compound material in a second direction substantially perpendicular to the first direction.

The conductive material may be orientated by applying a predetermined pressure to the compound material at a predetermined orientation, whilst the insulative material is at least partially melted.

The compound material may be orientated by extrusion through a die, the die having a land length of at least 10 mm.

The compound material may be orientated by at least one of hot rolling and cold rolling.

The conductive material may be orientated by applying at least one of an electric field and a magnetic field to the compound material at a predetermined orientation, whilst the insulative material is at least partially melted.

Embodiments of the present invention will now be described, by way of example only, with reference to the accompanying drawings, in which.

Figure 1A:
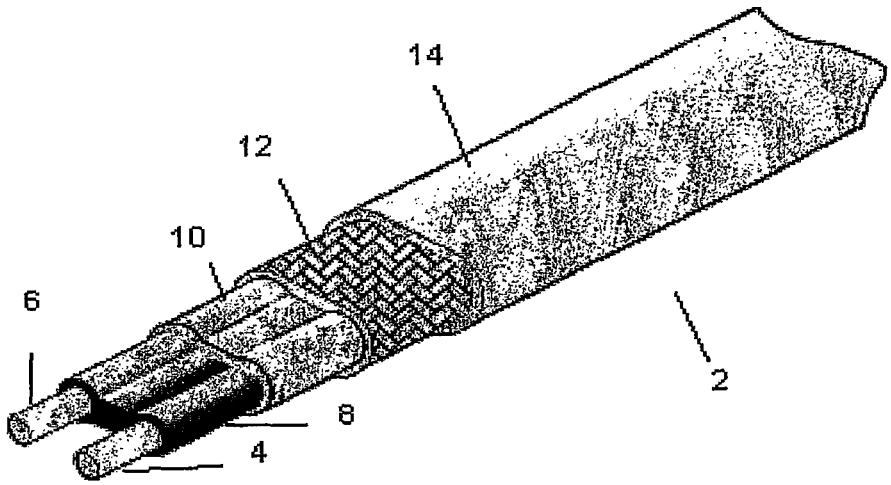
FIG. 1A is a partially cut away perspective view of a known parallel resistance self-regulating heating cable.
Figure 1B:
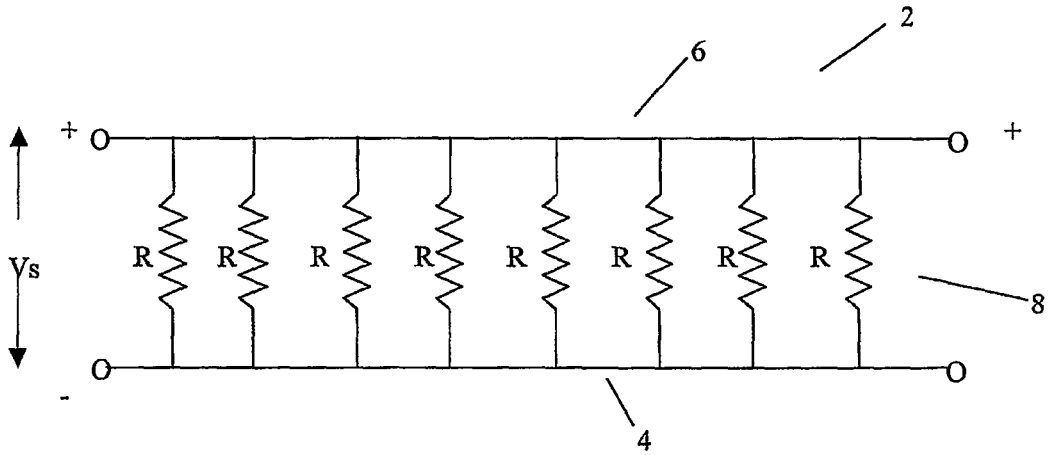
FIG. 1B is a schematic representation of the equivalent circuit provided by the heating cable of FIG. 1A.

Compound materials comprising a mixture of a conductive material and an insulative material are well known. Such compound materials can be either semi-conductive or conductive, depending upon the resistivity of the total material. The conductive material and the insulative material are generally chemically inert i.e. the conductive material and the insulative material do not react with each other The conductive materials within the compound material usually comprise conductive fillers such as metal powder, carbon black and graphite. The conductive fillers are usually uniformly distributed and randomly orientated within a matrix comprising the insulative material. Often, polymers such as thermoplastic or fluoropolymer are used as the insulative material. Such polymers may be highly crystalline. Such compound materials are widely used in electrically conductive products, in applications such as anti-static films, static dissipative films, electromagnetic interference shielding, and as a semi-conductive heating element in self-regulating heaters.

The present inventors have realised that it is possible to orient the conductive material within the compound material, such that the resistivity of the compound material varies with direction.

Generally, the conductive materials have a unique structure or primary particle shape, which is not broken by the normal mixing process used to form the compound material. For instance, the conductive material is typically distributed evenly throughout the compound material, with each agglomeration of conductive material generally having the same shape e.g. spherical, branched or structured, multi-layered, or in the shape of a bar. Such agglomerations are generally macromolecular in size. The term branched or structured does not necessarily refer to the material being covalently bonded and branched on the atomic scale, but refers to assemblies of atoms that are loosely bound together, with the ordering being on the macromolecular scale. Such strings or agglomerations of atoms can be interlinked i.e. branched or structured, forming a superstructure.

For instance, carbon black exists in spherical form, as well as in strand form. Further, graphite exists in multilayer form.

The electrical properties of the compound material will vary depending upon the concentration, distribution and properties of the conductive material agglomerations.

The present inventors have realised that the orientation of the agglomerations will affect the directionality of the resistivity. For instance, if a carbon fibre material is used as a filler within a compound material, then if the majority of the carbon fibres are aligned in one direction, then the resistivity will be lower along this direction. The resistivity will also be higher in a direction transverse to the alignment. In other words, a compound material can be produced which has anisotropic resistivity i.e. the resistivity varies with direction.

Orientation of the conductive material can be achieved by application of pressure. The conductive material tends to align in a plane extending substantially perpendicular to the applied pressure. This pressure should be exerted whilst the insulative material is in at least a jelly state, if not a molten state.

For instance a directionally conductive material can be produced from a known compound semi-conductive material with the initial formulation shown in table 1.

TABLE 1

| Type of Compound | Compound | % (Wt/Wt) |
|---|---|---|
| Conductive | Carbon black fibre concentrate | 71% |
| Insulative | High Density Polyethylene (HDPE) | 25% |
| Anti Oxidant | Zinc Oxide | 4% |

After compounding the net content of carbon fibre will be reduced to 21.4% by weight. This material is referred to herein as semi-conductive compound AA directionally conductive material can be produced using the following three-step procedure Step 1) Heating: A stack of the semi-conductive material in the steel template (length 10 cm, width 6 cm, height 10 cm) is heated to approximately 220° C. for approximately 5 minutes (to allow the insulative material to become relatively malleable, as it is just below the melting point).

Step 2) Pressing: A pressure is applied to the sample. This pressure is generated by a 5-tonne weight applied to a sample area of 60 square cm (length 10 cm×width 6 cm), and is applied for 5 minutes at 220° C. to align the carbon fibres. Before pressing the semi-molten granules had a thickness of approximately 10 mm and after pressing a uniform plaque was produced with a thickness of 2.5 mm.

Step 3) Cooling: The sample is then allowed to cool in air, until at room temperature. The rate of cooling of the material can be important. If the compound material remains malleable for a prolonged period of time, then the aligned conductive material may gradually re-orientate, so as to become un-aligned. Consequently, it is generally preferable to relatively rapidly cool the compound material after the alignment step, to prevent the materials within the compound changing orientation.

The resistivity of the sample is then measured. The resistivity of the sample in a direction parallel to that in which pressure was exerted will be approximately 63 Ωcm, whilst the resistivity in the plane perpendicular to the application of the pressure will be much lower at only 1.85 Ωcm.

Consequently, the conductive carbon fibres have aligned in the plane perpendicular to that in which pressure is applied. It will be appreciated that, by proper application of pressures (e.g. from 2 or more directions), the conductive material can be aligned as desired, so as to provide greater conductivity only in one direction, or in a plurality of predetermined directions.

The present invention is not limited to conductive materials in a fibre form, such as carbon fibre. Other agglomerates and particle shapes have also been shown to exhibit a similar effect. For instance, spherical carbon black shows the same directionality upon application of pressure. In carbon black, this is believed to be due to the spherical carbon agglomerates forming a pearl necklace type structure.

This can be used advantageously within electrical devices, including heating cables, in a number of possible applications.

For instance, in many applications it is desirable to have a semi-conductive compound material with a predetermined conductivity (the reciprocal of resistivity). For instance, in parallel resistance heating cables, it can be desirable that the conductivity of the semi-conductor material forming the heating element is a predetermined value. Previously, this predetermined value has been achieved by adding the conductive filler material into the insulative material (normally a polymer), until the desired level of conductivity is achieved. However, by orientating the conductive material within the semi-conductive compound, the desired level of conductivity can be achieved with a lower percentage of conductive material. Typically, the insulative material has better extrusion and/or moulding characteristics than the conductive material or other additives. Consequently, reducing the amount of conductive material in the compound material improves the extrusion or moulding processability and productivity. Further, this decrease in required level of conductive material can result in the semi-conductive compound material being cheaper.

Further, by appropriate control of the degree of orientation, as well as the direction of orientation, the nominally semi-conductive material can be made to act as an insulator in one direction, and a conductor in another direction. This allows completely new designs of heating cable to be made. For instance, a parallel resistance heating cable could be made in which not only the heating element is formed from a compound material, but also the insulator jacket and the conductive outer braid (or equivalent conductive covering).

Figure 2:
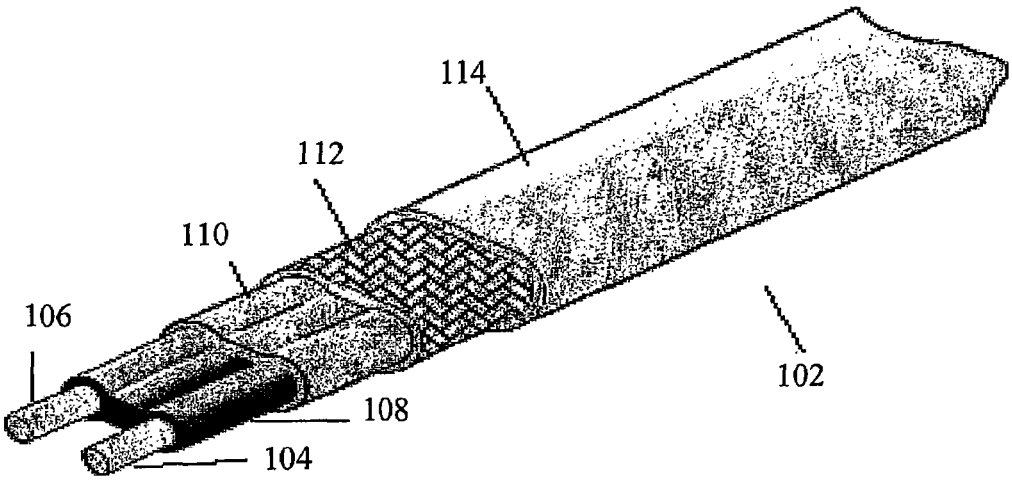
FIG. 2 is a partially cut away perspective view of a parallel resistance heating cable in accordance with a first embodiment of the present invention.

FIG. 2 shows a parallel resistance heating cable 102 in accordance with the first embodiment of the present invention. The cable 102 comprises two longitudinally extending, parallel power supply conductors 104, 106. Extruded around (and in particular between) the two conductors 104, 106, is a compound material 108 comprising a mixture of a conductive material and an insulative material.

The conductive material is carbon black, product grade BP460, made by Cabot Corporation, a particular grade of spherical carbon.

The insulative material is typically a polymer carrier such as high-density polyethylene Atofina product grade 2008 SN 60.

A typical compound formulation is shown in Table 2.

TABLE 2

| Type of Compound | Compound | % (Wt/Wt) |
|---|---|---|
| Conductive | Carbon Black | 14% |
| Insulative | High Density Polyethylene (HDPE) | 80% |
| Anti Oxidant | Zinc Oxide | 6% |

Surrounding the heating element 108 is an insulator jacket 110, a conductive outer jacket 112 and a thermoplastic over-jacket 114 for additional mechanical and corrosive protection.

Figure 3A:
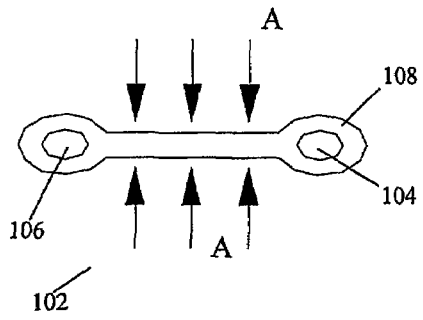
FIGS. 3A-3D are respectively cross-sectional, plan, cross-sectional and perspective views of the heating cable shown in FIG. 2, illustrating different characteristics of the cable.

In this particular embodiment, the heating element 108 has been formed by exerting a pressure on the portion of the heating element 108 extending between the two conductors 104, 106. The pressure is exerted substantially perpendicular to the plane in which the two conductors lie. FIG. 3A indicates the direction of the application of the pressure by arrows A.

Figure 3B:
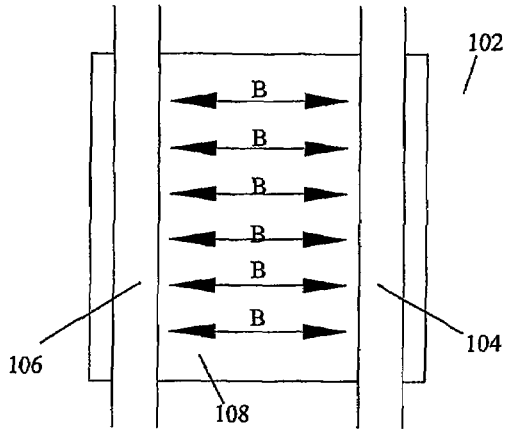

This pressure is applied subsequent to the heating element 108 being extruded, whilst the heating element is still malleable. The result, as indicated by the arrows B in FIG. 3B, is that the conductive filler is oriented to outline along the direction between the two conductors 104, 106.

Figure 3C:
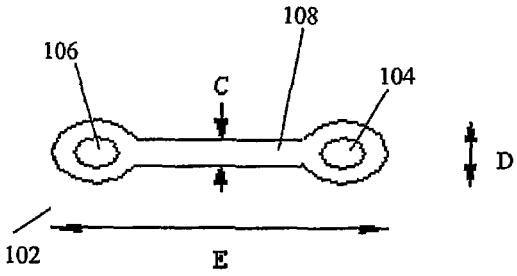

Typically, the heating cable will be several tens of meters, if not hundreds of metres in length. FIG. 3C indicates the typical cross-sectional dimensions of the cable 102. The cable 102 is generally of width E=9 mm, total thickness D=2 mm, and of thickness C=1.5 mm between the two conductors 104, 108.

Figure 3D:
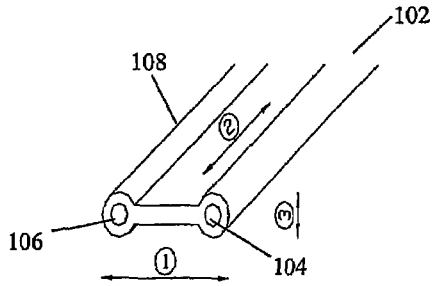

In a production trial a pressure of approximately 70 bars was exerted on the cable, whilst the cable was at a temperature of around 180° C., and was extruded at a rate of approximately 10 metres per minute. The result was that the resistivity of the heating element 108 varies with direction, as shown in FIG. 3B. The resistivity of the heating element in the direction between the two conductors 104, 106 (shown by arrow 1 in FIG. 3) was approximately 12 kΩ cm. The resistivity along the length of the cable (shown by arrow 2 in FIG. 3D) was approximately 15 kΩ cm. The vertical resistivity of the heating element 108 (as indicated by the arrow 3 FIG. 3D) was approximately 67 kΩ cm. Thus, it will be appreciated that, by appropriate application of pressure (e.g. pressure of approximately 200 bar), the resistivity of the compound material (i.e. the semi-conductor material forming the heating element) has been made directionally dependent.

In many instances, the insulator jacket 110 will be formed solely of a polymer, and the conductive jacket 112 formed solely of a metallic conductor. However, in this particular embodiment, both of these layers are formed of a compound material comprising a mixture of a conductive material and an insulative material. Most preferably, this compound material forming the insulator jacket 110 is the same as that forming the conductive jacket 112. Most preferably, the compound material is the same as that forming the heating element 108.

In this particular embodiment, a single outer sheath forms both the insulator jacket 110 and the conductive jacket 112. The sheath is formed such that the resistivity of the sheath is lowest along the length of the cable 102 (i.e. in the direction indicated by the arrow 2 in FIG. 3D). This allows the jacket 112 to be used as an earth wire. Such a jacket is typically much cheaper to manufacture than the normal conductive outer braid formed of tinned copper, due to lower materials costs. Further, this sheath can be formed by an extrusion process, and is thus much quicker to manufacture (typically, extrusion processes are an order of magnitude faster than braiding processes, in relation to the length of the cable covered).

In order to allow the conductive jacket 112 to also function as the insulator jacket 110, the conductive material is aligned within the jacket to ensure that the resistance of the compound material is high in the radial direction, such that the jacket acts as an insulator.

If the pressures and tools are correctly aligned, then the parallel resistance heating cable with associated insulative covering and conductive earth covering can be formed in a single process step. It is possible to form two separate layers simultaneously with a co-extruder.

Figure 4:
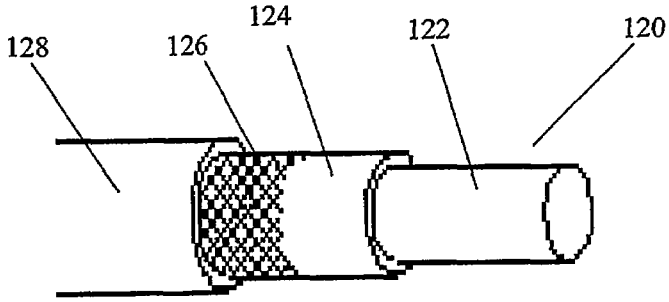
FIG. 4 is a partially cut away perspective view of a series resistance heating cable in accordance with a further embodiment of the present invention.

It will be appreciated that the present invention is not only applicable to parallel resistance heating cable. FIG. 4 shows a series resistance heating cable 120 in which the heating element 122 is formed from a compound material. Preferably, the compound material has a positive temperature coefficient of resistance. In this particular embodiment, the resistance of the compound material 122 is lowest in the longitudinal direction along the cable. This minimises the amount of conductive filler material required in the compound material, and facilitates extrusion of the heating element. The heating element 122 is encased within an insulative sheath 124, a conductive sheath 126 and an outer insulative jacket 128. As per the parallel resistance heating cable illustrated in FIG. 2, any one or more of the outer jackets or sheaths can be formed from a compound material. Further, the functionality of any two or more layers of these sheaths/jackets can be combined into a single outer sheath formed of such a compound material.

If the compound material is drawn slowly across a surface, whilst under pressure, then the conductive material will tend to align with the direction of the movement of the conductive material.

This drawing technique can easily be implemented within an extrusion process. Typically, the land area within an extrusion die is around 1 or 2 mm. By increasing the land area by an order of magnitude e.g. to at least 10 mm, and more preferably to at least 30 mm, then this alignment process may be carried out on the compound material. Experiments have indicated that not only the surface components of the conductive material within the compound material become aligned. This is believed to be due to a slip mechanism occurring within the heating cable, with different planes acting to drag against adjacent planes, such that the dragging mechanism effects the conductive material throughout the heating element.

Figure 5:
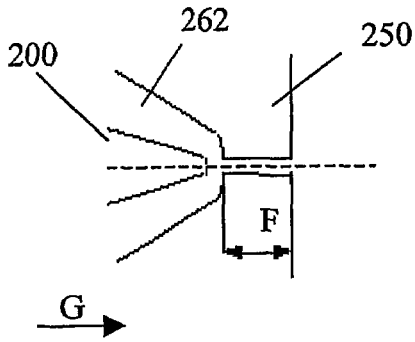
FIG. 5 illustrates a wire guide and a die in an extrusion head for forming the cable shown in FIG. 2.

FIG. 5 shows a wire guide 200 and a die 250 for implementing such an extrusion process. FIG. 6 shows the wire guide 200 in more detail, and FIG. 7 shows the die 250 in more detail. Within the die 250, the land area is of length F. The extrusion is being carried out in the direction indicated by the arrow G. The die described is suitable for producing a parallel resistance heating cable (see FIG. 3).

Figure 6A:
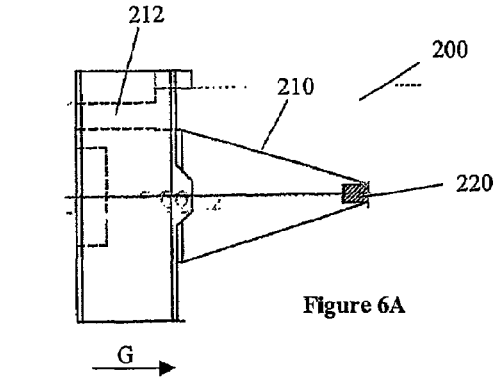
FIGS. 6A-6C illustrate respectively a side cross-section view, a plan cross-section view and an end view of the wire guide shown in FIG. 5.
Figure 6B:
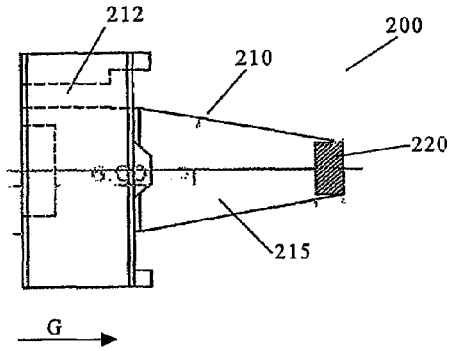
Figure 6C:
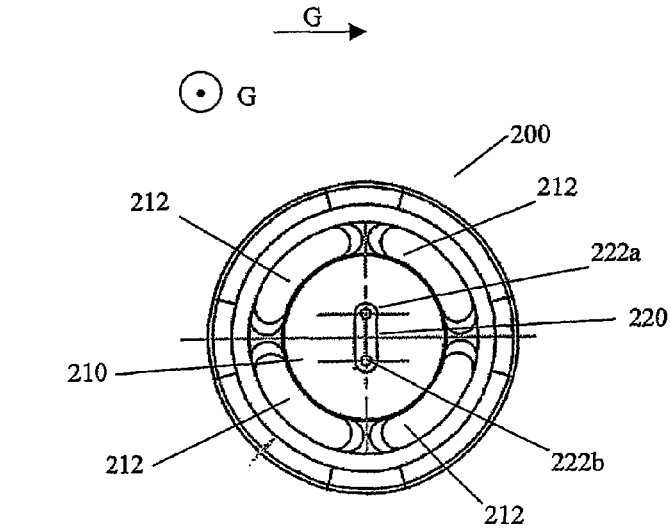

FIGS. 6A to 6C illustrate respectively a side cross-section view, a plan cross-section view and an end view of the wire guide 200. The wire guide 200 comprises a cone 210 which defines an internal space 215. Wires are passed through the internal space 215 and are pulled through apertures 222*a*, 222*b* in a block 220 in direction G. The wire guide is provided with apertures 212 arranged to receive heterogeneous compound material, and inject the material into an internal space 262 formed when the wire guide 200 is coupled with the die 250 (the internal space 262 is shown in FIG. 5). The material is injected at a predetermined pressure, for instance of approximately 50-55 bars. The material is preheated to a predetermined degree, depending upon the precise compound material (and particularly the properties of the insulative material).

Figure 7A:
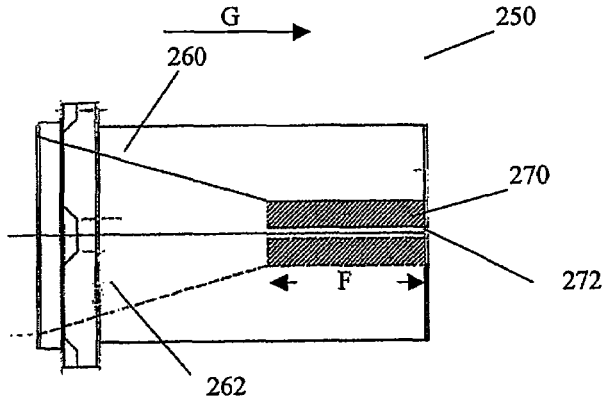
FIGS. 7A-7C illustrate respectively a side cross-section view, a plan cross-section view and an end view of the die shown in FIG. 5.
Figure 7B:
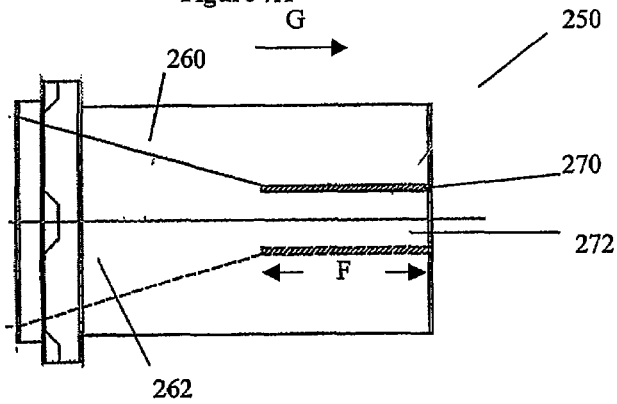
Figure 7C:
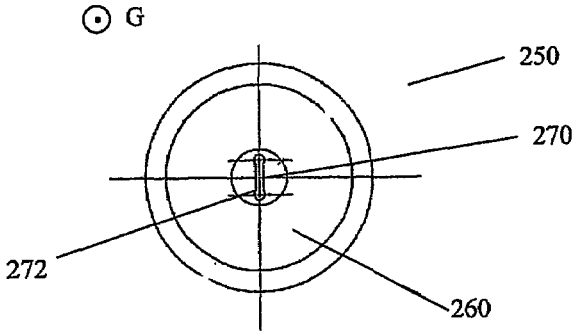

FIGS. 7A to 7C illustrate respectively a side cross-section view, a plan cross-section view and an end view of the die 250. The die 250 includes a conical inner surface 260 which together with the wire guide 200 forms the internal space 262 (see FIG. 5) into which heterogeneous compound material is injected. The die 250 is provided with a block 270 which has an aperture 272 that is dimensioned to form a cable of the shape shown in FIG. 3.

The blocks 220, 270 in the wire guide 200 and die 250 serve to define the relative apertures 222*a*, 222*b* and 272. By changing these blocks, the type of cable manufactured, and the shape of the cable can readily be altered.

In this particular example, the carbon fibre loaded semi-conductive compound that was used was semi-conductive compound A, the formulation of which is described above. The resulting cable was extruded at a rate of 10 metres per minute, with a temperature profile through the process. During extrusion, material is fed via a conduit, through a head to the extrusion die. Preferably, the material at the start of the conduit used to feed the die is at a lower temperature (e.g. by at least 30° C.) than the temperature of the head holding the die. The lower temperature leads to the material at that point being more viscous, increasing pressure within the extrusion process.

Preferably the die temperature is less than the head temperature (e.g. by at least 15° C.), such that the material exiting the die is more viscous. This leads to pressure being exerted on the extruded material, facilitating the orientation process.

The material is, due to the imposed pressure with which it is injected, extruded through the aperture 272. This aperture 272 defines the shape of the heating element. The material is guided to this aperture via an outer surface 210 of the wire guide 200, and inner surface 260 of the die 250, by the internal space 262 defined by both of these conical surfaces.

In relation to the above compound material and the above quoted conditions, this die and wire guide arrangement result in the production of parallel resistance heating cable, with a heating element having a great variation in resistivity with direction. For instance, in relation to the directions illustrated in FIG. 3D, the resistance along the length of the heating element (direction 2) was only 639 Ω cm (this is the direction in which the dragging operation was performed). However, the vertical resistivity (direction 3) varied from approximately 6.5 to 35 MΩ cm. The resistivity across the width of the heating element (direction 1) was an intermediate value of around 9 to 10 kΩ cm.

Table 3 summarizes a typical range and variation of the materials. Any one or more of the listed materials could be utilised, from any one or more of the listed types.

In the above embodiments, pressure extrusion has been described as the preferred mechanism by which the conductive material is orientated. However, it will equally be appreciated that other manufacturing methods may be utilised.

For instance, other processes could be used to apply pressure to obtain the desired alignment of the conductive material. Both hot rolling and cold rolling are known manufacturing techniques. In cold rolling, the rollers used to process (shape) the material are cold; in hot rolling the rollers are hot, to further heat the compound being rolled. Both hot rolling and cold rolling processes work by applying pressure to shape the material. Consequently, hot and cold rolling can be used to orientate the conductive material, by applying a predetermined pressure to the compound material at a predetermined orientation, whilst the insulative material is at least partially melted.

It is believed that the materials are orientated under pressure by the dragging effect of the different slip planes within the material. Consequently, another technique would be to equalise the dragging effect of having a cold (e.g die) surface, and extruding the material (through the cold die), such that the exterior surface of the material being extruded cools. This would lead to a dragging effect by the cold surface (of the die), due to the cooling of the outer layer of the material being extruded by the die.

Completely different mechanisms may of course be used to attempt to orientate the conductive material within the compound material. For instance, the conductive material may be aligned, or the distribution altered within the compound material, by appropriate application of electric and/or magnetic fields. For instance, if the conductor is a charged particle, then it possible to move and/or orientate the conductor by an electric field.

In any of the above manufacturing techniques, it is assumed that the insulative material is at a temperature where it is able to flow i.e. it is above the softening point. Further, it is assumed that the temperature has been applied to the compound material for a sufficient length of time to introduce flow conditions (i.e. enable at least some portions of the material to move/flow) throughout the portion of the material in which it is desired to orientate the conductive material.

If the compound material is manufactured from pellets, or other discrete agglomerations of material, by a pressure process, then preferably the pressure is applied of a sufficient value, and for a sufficient time, to remove voids from the compound material i.e. to form a solid body of compound material. Voids such as air bubbles may detract from the performance of the compound material.

Equally, it will be appreciated that one or more of the above methods could be used in combination, if desired, to provide a desired configuration of the conductor.

After the conductive material has been orientated within the compound material, then preferably the compound material is subsequently cooled at a fast enough rate to prevent loss of alignment of the conductive material.

In relation to processing techniques, then typically (e.g. for extrusion and hot/cold rolling) a cable could be processed (e.g. extruded) at a rate of between 1-50 metres per minute, and more typically 7-30 metres per minute. Pressure processes would typically use a pressure within the range 15 to 300 bars. Typically, processing techniques would warm the compound material to a temperature above the softening point, but to a temperature beneath the material decomposition point.

Although the above description generally relates to providing a compound material used in parallel resistance electrical heating cables, it will be appreciated that the present invention is not limited to such applications. In particular, the present invention can be utilised in any electrical (including electronic) devices, in which it is desirable to provide a material having a conductivity in one direction greater than a conductivity in a different direction.

For instance, the material could be formed as any single, continuous cable, with the conductivity greatest along the longitudinal axis of the cable (i.e. with the greatest resistivity radially from the axis). Such a cable could, assuming the longitudinal resistance is appropriate, be utilised as a heating cable. The exact longitudinal resistance required will obviously depend upon the specific application for which the heating cable is desired. Alternatively, such a configuration could, if the longitudinal resistance is very low, be used for any conductive cable e.g. a power cable, for use in high voltage (10 kV) power cable. In both instances, having a radially low conductivity could mean that little, or no, outer insulative covering is required.

One application of a cable having a radially low conductivity and a suitable longitudinal resistance with a positive temperature coefficient is as a vehicle seat heater. The seat heater may be of the series resistance type (i.e. the type shown in FIG. 4), but may not need any insulative cladding. The seat heater may for example comprise a single cable of material having a radially low conductivity and a suitable longitudinal resistance with a positive temperature coefficient, without any other material or layers being provided. The seat heater cable may be connected to a power supply and an on-off switch, and is self regulating due to the positive temperature coefficient of the material. A seat heater cable of this type is inexpensive to produce due to the low number of components used.

Equally, the compound material could be utilised to combine the function of any two or more layers in many electrical components. For instance, communication and data transmission cables frequently have a conductive outer sheath for use as shielding. The sheath is then surrounded by an insulative covering. It will be appreciated that both the outer sheath and the insulative covering (and, indeed, if required the inner insulative covering preventing the metal sheath/grade from contacting the conductor) could be replaced by a single layer of the compound material having directionally dependent conductivity.

Similarly, skin effect heat tracing systems typically can include an outer metallic pipe of relatively large diameter, with a conductor running down the centre of the pipe. The inner conductor is surrounded by an insulative layer to separate it from the pipe. Both the inner conductor and the insulative layer could be replaced by the compound material.

Further, the compound material could be used to define any conductive pathway surrounded by an insulative material e.g. it could be used to provide the conductive pathways/insulation layers within printed circuits. Such printed circuits could be implemented by appropriate orientation of the compound material on a supporting substrate, such as an epoxy board. Indeed, the compound material could be used to act as any conductive pathway. A bus-bar can be a constant-voltage conductor in a power circuit, or alternatively can be a supply rail maintained at a constant potential (e.g. 0 or earth) in electronic equipment. The compound material could be utilised to form a bus-bar. It is envisaged that the compound material would then have the greatest conductivity along the longitudinal length of the bar. Appropriate electrical connections could be made to the bus-bar by insertion of one or more conductors, each extending in a respective plane perpendicular to the longitudinal axis of the bar.

Additionally, if the compound material has a positive temperature coefficient of resistance, then the compound material can be used to implement any desired electrical device operating using such a characteristic. For instance, typically a thermistor comprises a PTC layer sandwiched between two conductive layers. The whole block is typically incorporated within an electrically insulative sheath. A compound material, as described herein, having a positive temperature coefficient of resistance, could be used to form not only the PTC material typically used within a thermistor, but also the conductive layers and the insulative outer sheath.

TABLE 3

Semi-Conductive Materials: Range of Formulations

| Type | Compounds could include but not be limited to | Addition Range |
|---|---|---|
| Conductive | Carbon Black<br>Graphite<br>Nanotubes<br>Metal Powders<br>Metal strand<br>Metal coated fibre | 2%-80% |
| Insulative | HDPE: High Density Polyethylene<br>MDPE: Medium Density Polyethylene<br>LLDPE: Linear Low Density Polyethylene<br>Fluropolymers | 20%-95% |
| | PFA: Copolymer of Tetrafluroethylene and Perfluoropropyl vinyl ether<br>MFA: Copolymer of Tetrafluoroethylene and Perfluromethylvinylether<br>FEP: Copolymer of Tetrafluoroethylene and Hexaflouropropylene<br>ETFE: Copolymer of Ethylene and Tetrafluroelhylene<br>PVDF: Polyvinylidene fluoride<br>Other Polymers | |
| | PP: Polyproprolene<br>EVA: Ethylene vinyl acetate | |
| Thermal Stabilisers | Zinc Oxide | 2%-30% |

The invention claimed is:

1. A parallel resistance heating cable comprising:

a heating element;

a longitudinal axis extending along the cable; and two power supply conductors extending parallel to the longitudinal axis, the two power supply conductors defining a plane, the heating element extending along the cable and between the power supply conductors, and connected in parallel between the power supply conductors;

the heating element comprising a compound material, the compound material comprising a mixture of an electrically conductive material and an electrically insulative material, the electrically conductive material comprising a plurality of agglomerates or particles;

wherein the agglomerates or particles are orientated or distributed within a first portion of the heating element extending between the two power supply conductors such that the resistivity of the first portion of the heating element in a first direction parallel to the longitudinal axis is lower than the resistivity of the first portion of the heating element in a second direction substantially perpendicular to the longitudinal axis and substantially perpendicular to the plane of the two power supply conductors;

wherein the agglomerates or particles are orientated or distributed within the first portion of the heating element extending between the two power supply conductors by the application of a predetermined pressure to the first portion of heating element in the second direction.

2. A parallel resistance heating cable as claimed in claim 1, wherein said resistivities differ by at least one order of magnitude.

3. A parallel resistance heating cable as claimed in claim 1, wherein the resistivity in one of said directions is equal to the resistivity of a conductor, and the resistivity in the other direction is equal to that of an insulator.

4. A parallel resistance heating cable as claimed in claim 1, wherein the compound material has a positive temperature coefficient of resistance.

5. A parallel resistance heating cable as claimed in claim 1, wherein the conductive material comprises at least one of: a metal; spherical carbon; highly structured carbon; carbon nanotubes; and graphite.

6. A parallel resistance heating cable as claimed in claim 1, wherein the conductive material is arranged as a plurality of individual particles within the compound material, the particles being at least one of: spherical, structured, multi-layered, and bar shaped.

7. A parallel resistance heating cable as claimed in claim 1, wherein at least a second portion of said compound material is arranged as a sheath substantially enclosing the heating element.

8. A parallel resistance heating cable as claimed in claim 7, wherein the resistivity of the sheath in the second direction is substantially equal to that of an insulator, such that the sheath forms an insulative jacket.

9. A parallel resistance heating cable as claimed in claim 7, wherein the resistivity of the sheath in the first direction is less than the resistivity of the sheath in the second direction, such that the sheath may be used as a conductive earth.

10. A method of manufacturing a parallel resistance heating cable, the method comprising:

providing a compound material comprising a mixture of an electrically conductive material and an electrically insulative material, the electrically conductive material comprising a plurality of agglomerates or particles;

providing two power supply conductors extending parallel to a longitudinal axis of the parallel resistance heating cable, the power supply conductors defining a plane;

substantially surrounding the power supply conductors with the compound material such that the power supply conductors and compound material are in electrical communication, the compound material forming a heating element; and applying a predetermined pressure to a first portion of the heating element extending between the two power supply conductors so as to orientate or distribute the agglomerates or particles within the first portion of the heating element such that the resistivity of the compound material within the first portion of the heating element in a first direction parallel to the longitudinal axis is lower than the resistivity of the compound material in a second direction, wherein the predetermined pressure is applied in the second direction and wherein the second direction is substantially perpendicular to the longitudinal axis and to the plane of the power supply conductors.

11. A method as claimed in claim 10, wherein the agglomerates or particles are orientated or distributed by applying the predetermined pressure to the first portion of the heating element whilst the insulative material is at least partially melted.

12. A method as claimed in claim 10, wherein the agglomerates or particles are orientated or distributed by extrusion through a die, the die having a land length of at least 10 mm.

13. A method as claimed in claim 10, wherein the agglomerates or particles are orientated or distributed by at least one of hot rolling and cold rolling.

14. A method as claimed in claim 10, wherein the predetermined pressure is in the range 15 to 300 bar.

15. A series resistance heating cable comprising:

a longitudinal axis extending along the cable;

a heating element extending along the longitudinal axis, the heating element comprising a compound material, the compound material comprising a mixture of an electrically conductive material and an electrically insulative material, the electrically conductive material comprising a plurality of agglomerates or particles; wherein the agglomerates or particles are orientated or distributed within the heating element such that the resistivity of the first portion of the heating element in a first direction parallel to the longitudinal axis is lower than the resistivity of the first portion of the heating element in a second direction substantially perpendicular to the longitudinal axis; and wherein the agglomerates or particles are orientated or distributed within the heating element by the application of a predetermined pressure to the heating element in the second direction.

16. A series resistance heating cable according to claim 15, wherein the series resistance heating cable is fitted to a seat and is arranged to act as a seat heater.

17. A series resistance heating cable as claimed in claim 15, wherein at least a portion of said compound material is arranged as a sheath substantially enclosing the heating element.

18. A series resistance heating cable as claimed in claim 17, wherein the resistivity of the sheath in the second direction is substantially equal to that of an insulator, such that the sheath forms an insulative jacket.

19. A series resistance heating cable as claimed in claim 17, wherein the resistivity of the sheath in the first direction is less than the resistivity of the sheath in the second direction, such that the sheath may be used as a conductive earth.

20. A series resistance heating cable as claimed in claim 15, wherein the predetermined pressure is in the range 15 to 300 bar.

21. A series resistance heating cable as claimed in claim 15, further comprising two power supply conductors connected to respective ends of the heating element.

22. A method of manufacturing a series resistance heating cable, the method comprising:

providing a compound material comprising a mixture of an electrically conductive material and an electrically insulative material, the electrically conductive material comprising a plurality of agglomerates or particles;

forming a heating element along a longitudinal axis using the compound material; and applying a predetermined pressure to the heating element during the forming of the heating element so as to orientate or distribute the agglomerates or particles within the heating element such that the resistivity of the compound material within the heating element in a first direction parallel to the longitudinal axis is lower than the resistivity of the compound material in a second direction substantially perpendicular to the longitudinal axis;

wherein the predetermined pressure is applied in the second direction substantially perpendicular to the longitudinal axis.

23. A method as claimed in claim 22 further comprising providing two power supply conductors for connection to respective ends of the heating element.

24. A method as claimed in claim 22, wherein the agglomerates or particles are orientated or distributed by applying the predetermined pressure to the first portion of the heating element whilst the insulative material is at least partially melted.

25. A method as claimed in claim 22, wherein the predetermined pressure is in the range 15 to 300 bar.

* * * * *

UNITED STATES PATENT AND TRADEMARK OFFICE

CERTIFICATE OF CORRECTION

PATENT NO. : 8,525,084 B2
APPLICATION NO. : 11/721927
DATED : September 3, 2013
INVENTOR(S) : Jason Daniel Harold O'Connor It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1562 days.

Signed and Sealed this
Fifteenth Day of September, 2015

Michelle K. Lee

Michelle K. Lee
*Director of the United States Patent and Trademark Office*